US007853440B2

(12) United States Patent
Cohen et al.

(10) Patent No.: US 7,853,440 B2
(45) Date of Patent: Dec. 14, 2010

(54) METHOD FOR LARGE-SCALE MODELLING AND SIMULATION OF CARBONATE WELLS STIMULATION

(75) Inventors: Charles Edouard Cohen, Rueil-Malmaison (FR); Didier Ding, Chatou (FR); Brigitte Bazin, Paris (FR); Michel Quintard, Montastruc-la-Conseillère (FR)

(73) Assignee: Institut Francais du Petrole, Cedex (FR)

( * ) Notice: Subject to any disclaimer, the term of this patent is extended or adjusted under 35 U.S.C. 154(b) by 786 days.

(21) Appl. No.: 11/684,019

(22) Filed: Mar. 9, 2007

(65) Prior Publication Data

US 2007/0244681 A1 Oct. 18, 2007

(30) Foreign Application Priority Data

Mar. 10, 2006 (FR) ..... 06 02139

(51) Int. Cl.
*G06G 7/48* (2006.01)

(52) U.S. Cl. ..... 703/6

(58) Field of Classification Search ..... 703/6
See application file for complete search history.

(56) References Cited

U.S. PATENT DOCUMENTS 6,196,318 B1 * 3/2001 Gong et al. ..... 166/308.2
7,561,998 B2 * 7/2009 Panga et al. ..... 703/10
2003/0225521 A1 * 12/2003 Panga et al. ..... 702/6
2006/0102349 A1 * 5/2006 Brady et al. ..... 166/282

FOREIGN PATENT DOCUMENTS

WO WO 02/066789 A1 8/2002
WO WO 2004/035988 A1 4/2004

OTHER PUBLICATIONS

F. Golfier et al., "Core-scale description of porous media dissolution during acid injection—Part I: Theoretical development", 2004, Computational and Applied Mathematics, vol. 23, issue 2-3, pp. 173-194.*
Jerka Simunek et al., "Review and comparison of models for describing non-equilibrium and preferential flow and transport in the vadose zone", 2003, Journal of Hydrology, vol. 272, pp. 14-35.*
Azita Ahmadi et al., "Transport in chemically and mechanically heterogeneous porous media V. Two-equation model for solute transport with adsorption", 1998, Advances in Water Resources, vol. 22, No. 1, pp. 59-86.*
F. Golfier et al., "On the ability of a Darcy-scale model to capture wormhole formation during the dissolution of a porous medium", 2002, Journal of Fluid Mechanics, vol. 457, pp. 213-254.*
V. Pomes et al., "On the use of upscaling methods to describe acid injection in carbonates", SPE 71511, 2001, Society of Petroleum Engineers, pp. 1-11.*

* cited by examiner

*Primary Examiner*—Paul L Rodriguez
*Assistant Examiner*—Russ Guill
(74) *Attorney, Agent, or Firm*—Antonelli, Terry, Stout & Kraus, LLP.

(57) ABSTRACT

Method for modeling acidification within a porous medium as a result of the injection of an acid.

A dual-medium model is constructed, considering a first sub-medium favorable to dissolution breakthroughs and a second sub-medium not favorable to dissolution breakthroughs. For each one of these sub-media, a metric-scale description of the acid transport, of the sub-medium and acid mass conservation and of the acid transfer from one sub-medium to the other sub-medium is achieved. This dual-medium model is then initialized from experimental calibrations. Finally, acidification of the medium is modelled by means of this dual-medium model.

9 Claims, 6 Drawing Sheets

FIG. 1A
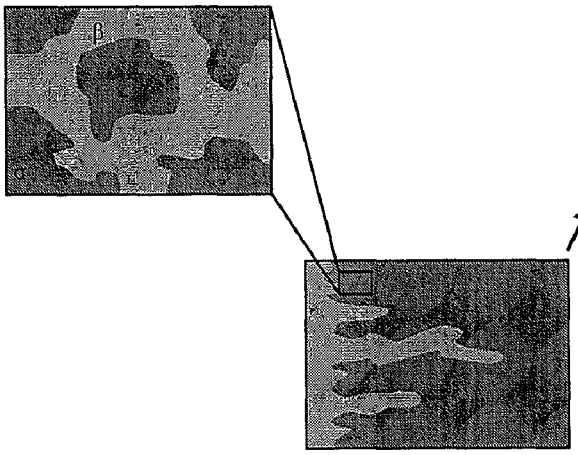
FIG. 1B
FIG. 1C
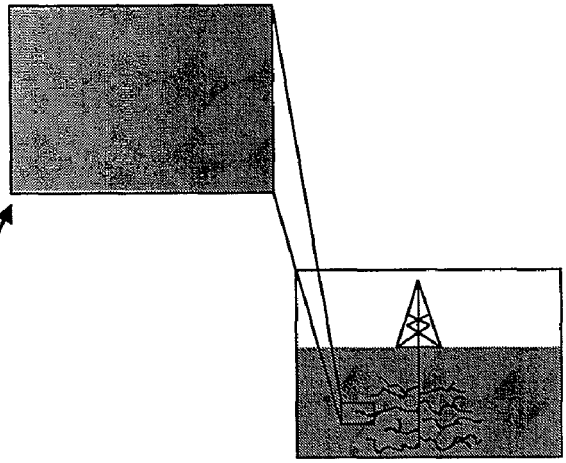
FIG. 1D

METHOD FOR LARGE-SCALE MODELLING AND SIMULATION OF CARBONATE WELLS STIMULATION

FIELD OF THE INVENTION

The present invention relates to a method for modelling the acidification within a porous medium as the result of the injection of a chemical such as an acid.

In particular, the invention allows to optimize acid injection parameters such as the flow rate and the zones to be treated within the scope of acid well stimulation in a carbonate context.

In the petroleum industry, the production of a well can be greatly reduced as a result of damage in the neighbourhood of the well. Damage comes in form of an alteration of the permeability and of the nature of the rock around the well. There are many operations likely to damage the well: drilling, casing, cementing, development, completion and treatment. The consequence of such damage is formation clogging, and thus hydrocarbon production reduction or even stop. It is therefore very important for the petroleum industry to identify, on the one hand, the damage type and, on the other hand, the damaged zones, in order to decide on and to work out a suitable treatment.

One of the treatments commonly used in the petroleum industry is acid injection around a well. This injection allows to reduce damage and therefore to improve the well production. The first goal of acid stimulation is to lower the flow resistance of reservoir fluids due to damage. The injected acid dissolves the material in the reservoir matrix and it creates channels that increase the permeability of the reservoir matrix. These channels are all the more frequent in carbonate rocks, i.e. rocks that contain more than 50% carbonate minerals (calcite, dolomite) such as limestones. The efficiency of this method depends on the type of acids used, on the rate of reactions, etc. While dissolution increases the permeability, it is observed that the relative increase in permeability for the injection of a given volume of acid greatly depends on the injection conditions.

In sandstone reservoirs, the reaction fronts tend to be uniform and flow channels are not observed. In carbonate reservoirs, according to the injection conditions, many wormholes can be created in the rock.

BACKGROUND OF THE INVENTION

It is therefore very important for the petroleum industry to identify, on the one hand, the damage type and, on the other hand, the damaged zones in order to optimize the acid stimulation parameters so as to produce wormholes with an optimum density and depth of penetration in the formation.

The formation and the behaviour of wormholes can be studied according to four different scales in order to determine the acid injection parameters:

the pore scale, which is the scale on which the chemical reaction mechanisms are described, the core scale, on which the wormhole instability appears, the well scale, which is the scale on which the competition between the wormholes and the impact of the heterogeneities on this scale can be appreciated, the reservoir scale, on which the effect of stimulation is measured by the skin factor.

FIGS. 1A to 1D, where medium σ represents the rock and medium β the water and the acid, illustrate these different scales involved in the acid stimulation:

FIG. 1A: pore scale (μm-mm)

FIG. 1B: core scale (mm-cm)

FIG. 1C: well scale (cm-m)

FIG. 1D: reservoir scale (m-km).

Many models such as those shown by Wang, Y., Hill, A. D., and Schechter, R. S., "The Optimum Injection Rate for Matrix Acidizing of Carbonate Formations", Paper SPE 26578, SPE ATCE, Houston, 1993, have already been proposed to study the effect of fluid leakage, of kinetic reactions, etc., on the rate of propagation of wormholes and the effect of the neighbouring wormholes on the dominant wormhole growth rate. The simple structure of these models has the advantage of studying in detail the reaction, the diffusion and convection mechanisms within the wormholes. However, these models cannot be used to study the initialization of wormholes and the effects on the formation heterogeneities.

Models describing dissolution upon acid injection have been used for the first time to describe this phenomenon on the scale of the pore. Such a method is for example described in Hoefner, M. L., Fogler, H. S., "Pore Evolution and Channel Formation During Flow and Reaction in Porous Media", AIChE J, 34, 45-54 (1998). However, core-scale simulation from these models is difficult and requires a high calculating capacity. Now, it is on this scale that the instabilities due to wormholes appear.

The first core-scale model likely to totally reproduce the dissolution mechanisms was proposed by Golfier, F. et al., "A discussion on a Darcy-scale modelling of porous media dissolution in homogeneous systems", Computational Methods in Water Resources, 2, 1195-1202 (2002). This single-medium model is constructed from a volume averaging of the equations on the scale of the pore. This modelling has also been used in international patent application WO-03/102, 362, which has extended the model to the case of a dissolution limited by the reaction kinetics. These models are based on a core-scale physics description, which requires grid cell sizes of the order of one millimeter.

However, an acid injection process is a well-scale process. It is therefore necessary to model the formation and the behaviour of the wormholes on this scale, all the more so since, in the petroleum industry, the spread of horizontal wells has generated an increase in the amounts of acid injected in a single well. The simulation means needs for increasing the chances of success of the treatment have grown. Now, the modellings described above do not allow to simulate acidification over a range representing the section of a well and its surroundings (1 to 3 m).

Models intended to simulate acid treatment on a larger scale than the core scale have already been proposed. Examples thereof are:

Buisje, M. A. Understanding Wormholing Mechanisms Can Improve Acid Treatments in Carbonate Formations. (SPE 38166). 1997. SPE European Formation Damage Conference.

Buisje, M. A. & Glasbergen, G. (SPE 96892). 2005. SPE Annual Technical conference and Exhibition.

Gdanski, R. A Fundamentally New Model of Acid Wormholing in Carbonates. (SPE 54719). 1999. SPE European Formation Damage Conference.

These methods rest on empirical considerations based on laboratory observations that are very far from the real conditions and dimensions.

The method according to the invention is a method for metric-scale modelling of the acidification within a porous medium as a result of acid injection, allowing to meet reservoir engineers' requirements for defining a suitable acid well stimulation scenario within the context of carbonate reservoirs.

SUMMARY OF THE INVENTION

The invention relates to a method for modelling acidification within a porous medium as a result of the injection of an acid, wherein said medium is represented by a dual-medium model, characterized in that the method comprises the following stages:

a) constructing said dual-medium model by considering a first sub-medium favourable to dissolution breakthroughs, and a second sub-medium that is not favourable to dissolution breakthroughs, by carrying out, for each one of said sub-media, a metric-scale description of the acid transport, the mass conservation of said sub-medium and the mass conservation of said acid, by describing an acid transfer from one sub-medium to the other sub-medium;

b) initializing said dual-medium model from experimental calibrations;

c) modelling, by means of said dual-medium model, said acidification by determining physical parameters representative of said porous medium and physical parameters relative to the acid injected.

The physical parameters representative of the porous medium can be selected, for each one of the sub-media, from among the following parameters: the mean porosity, the metric-scale permeability and the mean total pressure. The physical parameters relative to the acid can be selected, for each one of the sub-media, from among the following parameters: the mean acid concentration, the mean Darcy's velocity.

According to the invention, the description can be achieved by means of equations obtained by carrying out a metric-scale volume averaging of equations describing the propagation of an acid in a single-medium model on a centimeter scale. These equations then preferably comprise a dissolution term. The latter can be defined as the product of a metric-scale mean acid concentration by a coefficient depending on a local acid velocity. It can also be defined as the product of a parameter by the divergence of a product between an acid concentration, a fractional flow function and a velocity vector. The parameter of the latter dissolution term can depend on a norm of a local acid velocity and on the mean porosity on the metric scale.

According to the invention, the calibration procedure can be based either on simulations on a smaller scale than the metric scale, or on constant-flow acid injection surveys in a medium sample.

According to an embodiment, the porous medium can be a carbonate reservoir through which a well is drilled, acid injection being carried out to stimulate hydrocarbon production through said well, and optimum acid injection parameters are determined by carrying out the following stages:

a) constructing a grid of said well and of its neighbourhood;

b) defining initial acid injection parameters;

c) determining, by modelling the acidification due to acid injection, at least the following physical parameters representative of said reservoir: a porosity and a permeability of said reservoir after acid injection;

d) simulating the well production according to said porosity and to said permeability by means of a reservoir simulator;

e) modifying said initial parameters and repeating stage c) until a production maximum is obtained.

According to this embodiment, the initial parameters can be selected from among at least one of the following parameters: the acid injection rate, the initial injection velocity, the volume of acid injected, the concentration of the acid used for stimulation, the zones to be treated.

BRIEF DESCRIPTION OF THE FIGURES

FIGS. 1A to 1D show the different scales used for acid stimulation,

DETAILED DESCRIPTION

The method according to the invention allows to model the acidification of a porous medium due to the injection of a chemical such as an acid. Acidification involves several phenomena, the main ones being: dissolution of the medium by the acid and transport (propagation) of the acid within the medium. A dual-medium model allowing metric-scale modelling of these phenomena is therefore constructed.

The invention is described within the context of the acid stimulation of production wells. This stimulation consists in injecting acid around a well so as to increase the hydrocarbon production thereof. The method, once applied to a gridded domain representing the surroundings of a well to be stimulated, allows to simulate the evolution of the rock porosity and permeability, and thus to optimize the acid stimulation parameters such as the rate of injection and the treatment zone, in order to define the optimum acidification scenario for this well.

Figure 2:
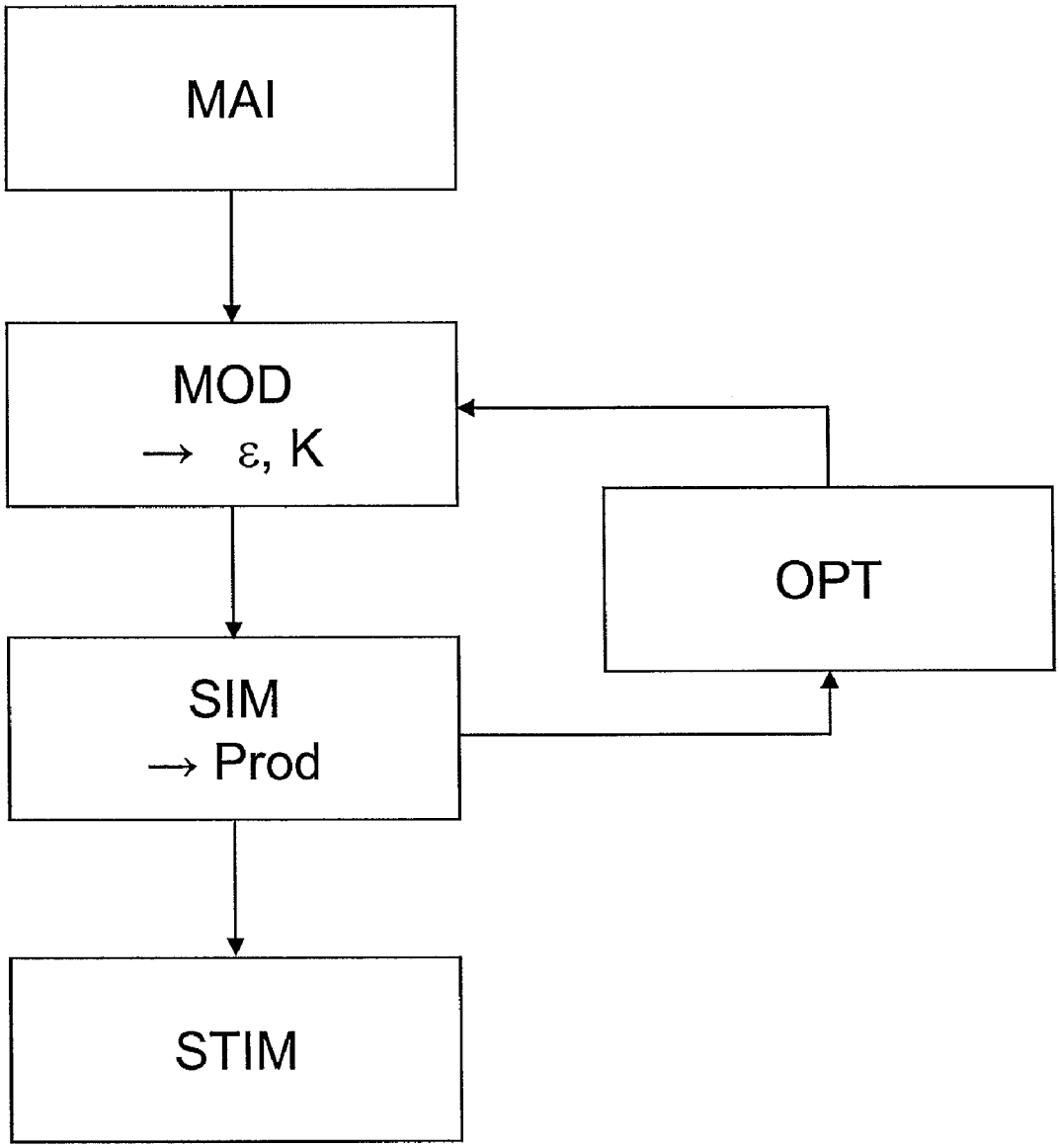
FIG. 2 illustrates the various stages of the method according to the invention.

FIG. 2 illustrates the various stages of the method applied to acid injection around a well:

1—Gridding of the well and of its surroundings (MAI)

2—Modelling of the acidification due to acid stimulation (MOD→$\epsilon$, K)

3—Well production simulation (SIM→Prod)

4—Acid injection parameters optimization (OPT)

5—Optimized acid well stimulation to increase its productivity (STIM).

1-Gridding of the Well and of its Surroundings

In order to allow the effects of acid stimulation on a well and its direct surroundings to be modelled, this space (well+surroundings) is discretized by means of a radial type structured grid. This grid type, well known to specialists, allows to take account of the radial directions of flow around the wells, and therefore to improve the calculation accuracy.

2-Modelling of the Acidification Due to Stimulation

This stage first requires definition of a dissolution and propagation (acidification) model allowing well-scale modelling of the formation and the behaviour of all the dissolution figures: compact front, conical wormhole, dominant wormhole, branched wormhole and uniform dissolution.

2.1-Well-Scale Acidification Model

In order to achieve well-scale modelling of the acid dissolution and propagation phenomena, a model based on fluid mechanics equations and on rock, fluid and acid mass conservation laws is constructed. According to the invention, this model is a dual-medium model constructed from a well-scale volume averaging of the equations describing propagation of the acid in a core-scale (cm-mm) single-medium model. These core-scale equations have been developed by Golfier, F. et al., "On the ability of a Darcy-scale model to capture wormhole formation during the dissolution of porous media", Journal of Fluid Mechanics, 547, 213-254, 2002.

The model according to the invention thus allows to use a radial grid whose radial extension is of the order of a centimeter and a meter. Acidification can therefore be simulated on a sufficiently large scale to reproduce all of an acid treatment and to assess the permeability increase around the well. Simulation of the permeability evolution then allows to simulate production and to optimize the acid injection parameters.

Figure 4:
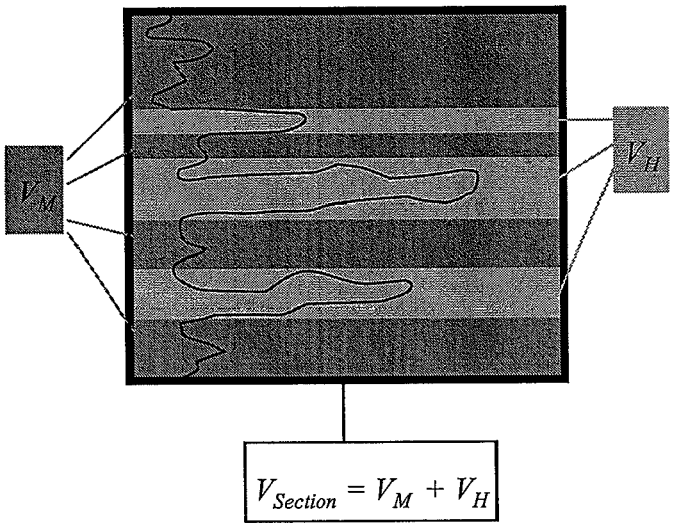
FIG. 4 shows the distribution of volumes $V_H$ and $V_M$ in the dual-medium approach according to the invention.

The dual-medium model is defined by considering that the reservoir rock consists of two media, H and M, of respective volumes $V_H$ and $V_M$, characterized by two different dissolution regimes. FIG. 4 illustrates these two media where $V_{Section}$ represents the volume of a section of a well, and the black curve represents the wormholes. According to the invention, the two regimes associated with the two media are defined as follows:

volume $V_M$ contains the high density of small-size (mm-cm) wormholes whose growth is rapidly completed (black curve in FIG. 4). This medium is representative of a compact regime wherein the wormholes have a short growth;

volume $V_H$ contains the dominant wormholes, i.e. the wormholes for which competition spreads over great distances (dm-m) and long times (FIG. 4). This medium is favourable to the development of wormholes and it is consequently characterized by a fast dissolution front.

Thus, medium H is favourable to the formation of dissolution breakthroughs: acid injection into such a medium causes formation of large wormholes whose size is generally above one decimeter. Medium M is not favourable to the formation of dissolution breakthroughs: acid injection into such a medium does not cause formation of large wormholes and it allows, at best, formation of small wormholes whose size is generally less than one decimeter.

Well-scale volume averaging of the equations describing the acid propagation in a core-scale single-medium model is carried out for well-scale description of the acidification phenomena. Thus, for any variable $\phi$ allowing core-scale acidification description, applying the averaging theorem allows to calculate the following variables, which allow well-scale acidification description:

$$\{\varphi\}_H = \frac{1}{V_{Section}}\int_{V_H}\varphi\, dV \text{ and } \{\varphi\}_M = \frac{1}{V_{Section}}\int_{V_M}\varphi\, dV \tag{1}$$

$$\{\varphi\}_H^H = \frac{1}{V_H}\int_{V_H}\varphi\, dV \text{ and } \{\varphi\}_M^M = \frac{1}{V_M}\int_{V_M}\varphi\, dV \tag{2}$$

$$\phi_H = \frac{V_H}{V_{Section}} \text{ and } \phi_M = \frac{V_M}{V_{Section}}, \text{ i.e. } \phi_H = 1 - \phi_M \tag{3}$$

-continued $$\{\varphi\}_H = \phi_H\{\varphi\}_H^H \text{ and } \{\varphi\}_M = \phi_M\{\varphi\}_M^M \text{ with } \phi_{wh} = \frac{V_{wh}}{V_{Section}} \tag{4}$$

$$\{\varphi\} = \phi_H\{\varphi\}_H^H + \phi_M\{\varphi\}_M^M \tag{5}$$

The well-scale dual-medium acidification model according to the invention comprises, for each one of media M and H:

an acid species transport equation consisting of:

convective terms containing a fractional flow type function allowing to partly reproduce the dispersion linked with wormholing, reactive terms, an accumulation term;

a Darcy's equation, a rock mass conservation equation, a fluid mass conservation equation, a system closure equation connecting permeability and porosity.

The dual-medium model according to the invention is written as follows:

Medium H

Acid species transport equation in medium H $$\phi_H\varepsilon^H\frac{\partial C'^H}{\partial t} + \nabla\cdot(\phi_H V'^H f'^H) - \psi' C_{H-M}(P'^M - P'^H) = -\phi_H g'_H \tag{6}$$

Darcy's equation applied to medium H $$V'^H = -K'^H\cdot\nabla P'^H \tag{7}$$

Rock mass conservation equation in medium H $$\frac{\partial\varepsilon^H}{\partial t} = N_{ac}g'_H \tag{8}$$

Fluid mass conservation equation in medium H $$\nabla\cdot(\phi_H V'^H) - \psi'(P'^M - P'^H) = 0 \tag{9}$$

Equation connecting permeability and porosity in medium H $$K^H = K_0 + (K_f - K_0)\left(\frac{\varepsilon^H - \varepsilon_0}{1 - \varepsilon_0}\right)^\chi \tag{10}$$

Medium M

Acid species transport equation in medium M $$\phi_M\varepsilon^M\frac{\partial C'^M}{\partial t} + \nabla\cdot(\phi_M V'^M f'^M) + \psi' C_{H-M}(P'^M - P'^H) = -\phi_M g'_M \tag{11}$$

Darcy's equation applied to medium M $$V'^M = -K'^M\cdot\nabla P'^M \tag{12}$$

Rock mass conservation equation in medium M $$\frac{\partial \varepsilon^M}{\partial t} = N_{ac} g'_M \tag{13}$$

Fluid mass conservation equation in medium M $$\nabla\cdot(\phi_M V'^M) + \phi'(P'^M - P'^H) = 0 \tag{14}$$

Equation connecting permeability and porosity in medium M $$K^M = K_0 + (K_f - K_0)\left(\frac{\varepsilon^M - \varepsilon_0}{1 - \varepsilon_0}\right)^{\chi} \tag{15}$$

With the following variables used to nondimensionalize the system:

$$t' = \frac{V_0}{L} t \quad x' = \frac{x}{L} \tag{16}$$

$$C'^H = \frac{\{C_{A\beta}\}_H^H}{C_0} \quad C'^M = \frac{\{C_{A\beta}\}_M^M}{C_0} \tag{17}$$

$$V'^H = \frac{\{V_\beta\}_H^H}{V_0} \quad V'^M = \frac{\{V_\beta\}_M^M}{V_0} \tag{18}$$

$$f^H(\{C_{A\beta}\}_H^H) = \frac{\{C_{A\beta}\}_H^H}{\frac{\{C_{A\beta}\}_H^H}{C_0} + \left(1 - \frac{\{C_{A\beta}\}_H^H}{C_0}\right)\Big/ H^H} \tag{19}$$

$$f^M(\{C_{A\beta}\}_M^M) = \frac{\{C_{A\beta}\}_M^M}{\frac{\{C_{A\beta}\}_M^M}{C_0} + \left(1 - \frac{\{C_{A\beta}\}_M^M}{C_0}\right)\Big/ H^M}$$

$$f'^H = \frac{f^H}{C_0} \quad f'^M = \frac{f^M}{C_0} \tag{19'}$$

$$P'^H = \frac{K_0}{\mu V_0 L}\{P\}_H^H \quad P'^M = \frac{K_0}{\mu V_0 L}\{P\}_M^M \tag{20}$$

$$K'^H = \frac{K^H}{K_0} \quad K'^M = \frac{K^M}{K_0} \tag{21}$$

$$g'_H = \frac{g_H L}{V_0 C_0} \quad g'_M = \frac{g_M L}{V_0 C_0} \tag{22}$$

$$N_{ac} = \frac{v C_0}{\rho^\sigma} \quad \psi' = \frac{\psi \mu L^2}{K_0} \tag{23}$$

The acidification model output data are:

$\{C_{A\beta}\}_M^M$=mean acid concentration in medium M (Kg/m$^3$)

$\{C_{A\beta}\}_H^H$=mean acid concentration in medium H (Kg/m$^3$) (24)

$\{V_\beta\}_M^M$=mean Darcy's velocity in medium M (m/s)

$\{V_\beta\}_H^H$=mean Darcy's velocity in medium H (m/s) (25)

$\{P\}_M^M$=mean total pressure in medium M (Pa)

$\{P\}_H^H$=mean total pressure in medium H (Pa) (26)

$\{\epsilon_\beta\}_H^H = \epsilon^M$ mean porosity in medium M $\{\epsilon_\beta\}_H^H = \epsilon^H$ mean porosity in medium H (27)

$K^M$=permeability in medium M on the scale of the section (m$^2$)

$K^H$=permeability in medium H on the scale of the section (m$^2$) (28)

The acidification model input data are:

$V_0$=initial acid injection velocity $C_0$=concentration of the acid used upon stimulation $\epsilon_0$=initial porosity $K_0$=initial permeability L=characteristic length of the problem (radius of the acidized zone)

$\mu$=kinematic viscosity (Pa·s)

v=stoichiometric coefficient of the dissolution reaction $\rho^\theta$=rock density (Kg/m$^3$)

$K_f$=permeability in the dissolved medium (m$^2$).

These data are obtained from logs, measurements on cores or laboratory measurements. These parameters can also result from specialists' geologic knowledge or from simulations. The initial porosity and permeability are then optimized during an optimization process based on the modelling of the acidification due to an acid injection in the well.

$K_f$ corresponds to the permeability in the wormhole and its value is therefore very great. It is calculated by analogy with a Poiseuille's flow in a wormhole. By taking b as the characteristic radius of the wormhole equal to 1 millimeter, we obtain:

$$K_f = \frac{b^2}{12} = 8{,}33.10^{-8}\ \text{m}^2 \text{ in } 2D \text{ (flow between two parallel plates)} \tag{29}$$

$$K_f = \frac{b^2}{8} = 1{,}25.10^{-7}\ \text{m}^2 \text{ in } 3D \text{ (flow in a tube)}$$

The accuracy of the value assigned to $K_f$ is of little importance insofar as it is much greater than $K_0$.

Some parameters of the acidification model have to be determined prior to acidification modelling.

Concerning the dissolution coefficients $g_M$ and $g_H$, two different formulations can be constructed through two different approaches: $g_{1M}$, $g_{1H}$ on the one hand and $g_{2M}$, $g_{2M}$ on the other hand. One depends on the concentration and on the porosity, the other on the velocity, the porosity and the local balance of the acid flow.

Dissolution Terms $g_{1H}$ and $g_{1M}$

The volume averaging gives non-linear dissolution terms $g_H$ and $g_M$ that therefore have to be modelled. A first approach consists in linearizing these terms. We thus obtain terms $g_{1H}$ and $g_{1M}$ that only depend on parameter A.

$$g_{1H} = \alpha_{1H}\{C_{A\beta}\}_H^H$$

$$g_{1M} = \alpha_{1M}\{C_{A\beta}\}_M^M$$

with $$\alpha_{1H} = A(1-\epsilon^H)^{2/3}$$

$$\alpha_{1M} = A(1-\epsilon^M)^{2/3} \tag{31}$$

$g_{1H}$ is the dissolution term for medium H and $g_{1M}$ the dissolution term for medium M. The purpose of this expression of coefficients $\alpha_{1H}$ and $\alpha_{1M}$ is to take account of the evolution of the reaction surface area by means of the porosity variation.

After nondimensionalizing, we obtain:

$$g'_{1H} = \frac{L}{V_0} C'^H A(1-\varepsilon^H)^{2/3} \tag{32}$$

$$g'_{1M} = \frac{L}{V_0} C'^M A(1-\varepsilon^M)^{2/3}$$

Dissolution Terms $g_{2H}$ and $g_{2M}$

According to another embodiment, another modelling (term $g_{2M}$ and $g_{2M}$) based on the observation of the wormholing mechanism is presented. Coefficient $g_{2M}$ is the dissolution term for medium H and $g_{2M}$ the dissolution term for medium M. Its principle is to define the dissolution term according to the local balance of the acid flows, i.e. the convective term. This term is zero when there is no acid, no flow or when a wormhole runs right through the elementary volume on the scale of the well (the elementary volume principle is linked with the scale to which the system of equations relates). On the other hand, if a wormhole ends its growth in this volume, the acid flow balance becomes negative and dissolution therefore occurs.

$$g'_{2M} = \frac{\alpha'_{2M}}{\phi_M} \nabla \cdot (\phi_M V'^M f'^M) \tag{33}$$

$$g'_{2H} = \frac{\alpha'_{2H}}{\phi_H} \nabla \cdot (\phi_H V'^H f'^H) \tag{34}$$

with $$\alpha'_{2M} = (\varepsilon_M)^{n1} \left( \frac{1}{\gamma \| V'_M \|} \right)^{n2} \tag{35}$$

$$\alpha'_{2H} = (\varepsilon_H)^{n1} \left( \frac{1}{\gamma \| V'_H \|} \right)^{n2} \tag{36}$$

Thus, the parameters of the dual-medium acidification model that have to be determined are as follows:

- A, $\phi$H, $H^M$, $H^H$, $\Delta y$ that appear in the dual-medium model when using dissolution terms $g_{1M}$ and $g_{1H}$,
- $n_1$, $n_2$, $\gamma$, $\phi_H$, $H^M$, $H^H$, $\Delta y$ that appear when using dissolution terms $g_{2M}$ and $g_{2H}$,
- $\chi$ that appears in the permeability/porosity equation,
- $\psi$ the coefficient of exchange between the two media,
- $C_{H\text{-}M}$ the concentration at the interface between the two media ($Kg/m^3$).

2.2-Determination of the Model Parameters

All these parameters are determined by calibration in relation to core-scale simulation results or laboratory tests. These calibrations are presented hereafter:

Calibration of the Parameters of the Dissolution Coefficients

The parameters used in our model are determined by a procedure of calibration in relation to reference results covering a wide range of flow rates. These flow rates must be selected in the flow rate range in which wormholes form. These reference results are, on the one hand, the exact porosity on the core scale, averaged on the well scale, and on the other hand the pressure field denoted by $\Delta P(t)$. The latter can be obtained either from laboratory experiments, such as constant-flow injection surveys on a rock sample, or from core-scale single-medium simulations on small-size domains (core scale).

Well-scale determination of the parameters allowing to reproduce the results obtained on the core scale is carried out by means of an inversion method using a Levenberg-Maquart algorithm (K. Madsen, H. B. Nielsen, O. Tingleff, *Methods for Non-Linear Least Squares Problems,* 2004, Informatics and Mathematical Modelling, Technical University of Denmark). This procedure allows to determine parameters A, $\phi_H$, $H^M$, $H^H$, $\Delta y$ that appear in the dual-medium model using dissolution terms $g_{1M}$ and $g_{1H}$. Similarly, this procedure allows to determine parameters $n_1$, $n_2$, $\gamma$, $\phi_H$, $H^M$, $H^H$, $\Delta y$ that appear in the dual-medium model using dissolution terms $g_{2M}$ and $g_{2H}$.

These parameter determinations are carried out in relation to reference results covering a wide range of flow rates. For another flow rate, the value assigned to each parameter for the well-scale model is determined by a linear interpolation performed by comparing the section-scale velocity averaged on volume $V_{section}$ with the injection velocity of the core-scale single-medium simulations.

Interpolations of these values according to the flow rate allows to carry out large-scale simulations over a large-size domain (well scale).

Calibration of Parameter $\chi$

This parameter is also determined by means of a calibration procedure in relation to reference results covering a wide range of flow rates selected in the flow rate range in which wormholes form. The latter can be obtained either from laboratory experiments, such as constant-flow injection surveys on a rock sample, or from core-scale single-medium simulations over small-size domains (core scale).

Figure 3:
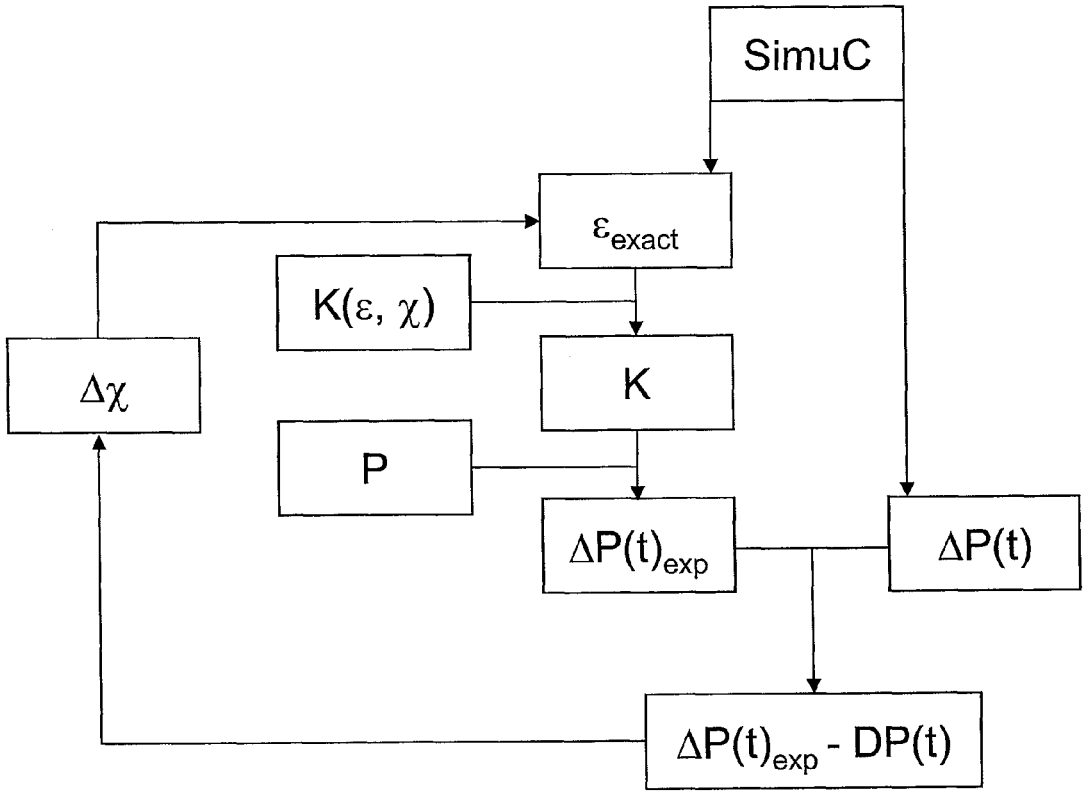
FIG. 3 illustrates the various stages of calibration of parameter $\chi$.

This calibration method is illustrated in FIG. 3. To determine coefficient $\chi$, it is possible to use a calibration in relation to core-scale constant-flow simulation results (SimuC). The flow rate applied to a sample of the size of a core must be selected in the flow rate range in which wormholes form. The porosity and the pressure field ($\Delta P(t)$) are extracted from these core-scale results and used as reference results. The well-scale mean of the porosity obtained on the core scale is calculated for different dissolution times. This new porosity $\epsilon_{exact}$ is applied to the relation connecting the permeability and the porosity and described above, $K(\epsilon, \chi)$:

$$K = K_0 + (K_f - K_0)\left(\frac{\varepsilon_{exact} - \varepsilon_0}{1 - \varepsilon_0}\right)^{\chi} \tag{37}$$

The permeability thus calculated represents the well-scale mean permeability (K). The pressure field (P) induced by this permeability is solved using the following relation:

$$\nabla \cdot (K \nabla P) = 0 \tag{38}$$

To simplify determination of parameter $\chi$, it is also possible to use tests on a linear flow in a homogeneous medium so as to be able to solve Equation (41) in 1D analytically by means of the relation as follows:

$$P(L) - P(0) = U\mu \int_0^L \frac{1}{K(x)} dx \tag{39}$$

U corresponds to the injection velocity.

We thus obtain the pressure difference between the limits of the domain at different times, i.e. the pressure gradient at the sample boundaries ($\Delta P(t)_{exp}$). We then calculate the difference between this gradient and the reference result $\Delta P(t)$. According to the error then measured, parameter $\chi$ is consequently modified ($\Delta\chi$).

An optimum value of $\chi$ is iteratively obtained, which minimizes this error. This optimum value of $\chi$ is obtained for a given flow rate. The operation is repeated for various flow rates selected in the flow rate range in which wormholes form. Relation $K(\epsilon)$ thus parameterized is then used for all the flow rates during well-scale simulations. If the given flow rate has not served for evaluation, a value interpolation is carried out for the flow rates used between which the given flow rate lies.

Calibration of Exchange Parameter $\psi$ Between the Two Media H and M

The two media H and M interact by means of an exchange term depending on the pressure difference between these two media. This term allows to model the acid flow diversion towards the dominant wormholes to the detriment of those present in medium M.

Figures 5A, 5B, 5C:
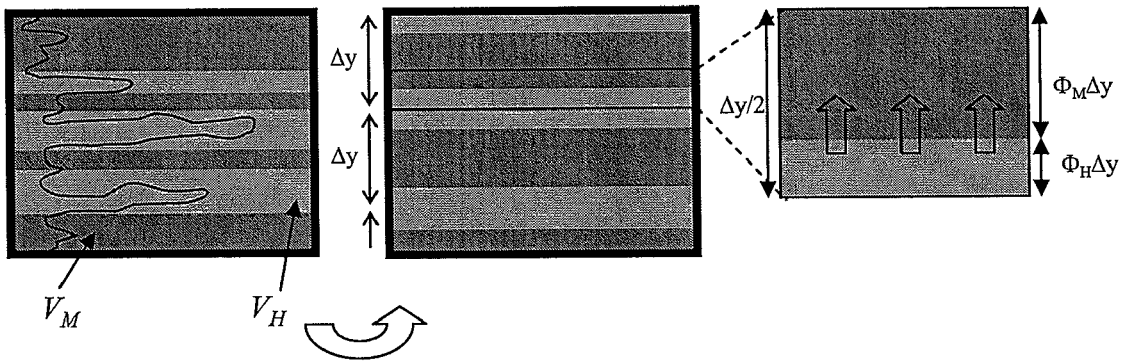
FIGS. 5A to 5C show the simplified representation of the distribution of the volumes $V_H$ and $V_M$ used in the exchange term modelling.

The model is applied to a particular case to determine exchange term $\psi$. The volume is represented by a medium wherein acid is injected linearly. Cylindrical wormholes, arranged periodically according to their size, develop therein. The equivalence between this representation and reality is provided by a parameter $\Delta y$ that has to be determined by calibration. $\Delta y$ defines here the distance between two dominant wormholes. FIGS. 5A, 5B and 5C show the simplified representation of the distribution of volumes $V_H$ and $V_M$ used in the exchange term modelling: FIG. 5A shows the real dissolution figure, FIG. 5B illustrates the simplified representation and FIG. 5C illustrates the base pattern. This periodic representation allows to show the exchange terms for the entire domain from its description in a base pattern. In this description, volume $V_{section}$ contains n times the base pattern.

$$\frac{1}{V_{section}}\int_{A_{H-M}} V_\beta \cdot n_M \, ds = \frac{1}{V_{section}}\int_{A_{H-M}} \left(-\frac{K}{\mu}\cdot\nabla P\right)\cdot n_M \, ds \approx \frac{1}{\Delta x\cdot n\cdot\Delta y}\left(-\frac{K_{eq_y}}{\mu}\frac{\partial P}{\partial y}\right)2\cdot n\cdot\Delta x \tag{40}$$

The pressure gradient at the interface is evaluated by dividing the difference of the mean pressures of the two media by the height $\Delta y/2$ of the base pattern (FIG. 5C). The equivalent permeability $K_{eq_y}$ is a variable calculated by working out a harmonic mean of the transverse permeabilities ($K_{y_H}$ and $K_{y_M}$) of the two media.

$$\frac{1}{V_{section}}\int_{A_{H-M}} V_\beta \cdot n_M \, ds \approx -\frac{4K_{eq_y}(\{P\}_M^M - \{P\}_H^H)}{\mu\Delta y^2} \tag{41}$$

with $$K_{eq_y} = \frac{K_{y_H}\cdot K_{y_M}}{\phi_M K_{y_H} + \phi_H K_{y_H}} \tag{42}$$

The transverse permeabilities must now be defined. We therefore use an ideal representation of each medium by modelling them as blocks through which a certain amount of constant-section wormholes run. By applying Darcy's law to this representation in order to determine $K_{y_M}$ and $K_{y_H}$, we obtain:

$$K_{y_H} = \frac{K_0\cdot K_f}{(1-A_H)K_f + A_H K_0},\ A_H = \frac{\varepsilon_H - \varepsilon_0}{1-\varepsilon_0} \tag{43}$$

-continued $$K_{y_M} = \frac{K_0\cdot K_f}{(1-A_M)K_f + A_M K_0},\ A_M = \frac{\varepsilon_M - \varepsilon_0}{1-\varepsilon_0} \tag{44}$$

Term $\psi$ can finally be written in the following form, according to parameter $\Delta y$.

$$\psi = \frac{4K_{eq_y}}{\mu\Delta y^2} \tag{45}$$

Calibration of the Concentration at the Interface Between the Two Media $C_{H\text{-}M}$ Concerning the concentration $C_{H\text{-}M}$ used with the exchange term in the dual-medium model, we use either concentration $C'^M$ or concentration $C'^H$ according to the values of $P'^M$ and $P'^H$:

If $P'^M \geqq P'^H$ then $C_{H\text{-}M} = C'^M$

If $P'^M < P'^H$ then $C_{H\text{-}M} = C'^H$

At each time interval, the pressure field is first solved. $C_{H\text{-}M}$ can therefore be determined prior to the acid species transport calculation.

2.3-Acidification Modelling

Equations 6 to 15 define the acidification model according to the invention, the input data and the parameters of this model are determined experimentally. This model then allows to determine the porosity and the permeability of the medium after acid injection in the well. A factor referred to as skin factor is determined from this new porosity and permeability. The skin factor measures the pressure drop due to the damage caused to a well of radius $r_w$. Consider these pressure drops limited to a radius $r_s$, wherein the permeability is k, while the reservoir permeability is k. Skin factor S is calculated from the formula as follows:

$$Q = \frac{2\pi kh}{B\mu}\frac{\Delta P}{\ln\frac{r_e}{r_w} + S}$$

with:

Q=rate of inflow in the formation ($m^3.s^{-1}$)

k=permeability in the reservoir ($m^2$)

B=volume factor $r_w$=well radius (m)

$r_e$=reservoir radius

S=skin factor $\Delta P$=pressure difference between the well and the reservoir $\mu$=kinematic viscosity (Pa·s)

Parameters k, B, $r_w$, $r_e$ of this equation being assumed to be known, and the simulator allowing to know the rate of inflow Q and the pressure field $\Delta P$, skin factor S can be calculated from this formula. In general, the skin factor of a well is evaluated from well tests. When it is positive, the well is damaged. The treatment reduces the skin and can even sometimes make it negative.

3-Well Production Simulation

A reservoir simulation well known to specialists is performed from the skin factor thus obtained, by means of a reservoir simulator. This simulation gives, among other things, an estimation of the well production.

4-Optimization of the Acid Injection Parameters

The reservoir simulation thus provides an estimation of the production from the skin factor, itself obtained from the acidification modelling. In order to improve production, the input parameters of the well-scale acidification model, i.e. the injection velocity, the acid volume, the concentration $C_0$ of the acid used during stimulation and the identification of the zones to be treated, defined by their initial porosity $\epsilon_0$ and their initial permeability $K_0$, just have to be modified.

5-Optimized Acid Well Stimulation to Increase its Productivity

From the parameters thus optimized, i.e. allowing to obtain a maximum well production, we carry out an acid well stimulation by injecting acid under optimum conditions in terms of injection velocity, volume and concentration $C_0$ of the acid used during stimulation and identification of the zones to be treated.

APPLICATION EXAMPLE

According to an example of application of the method according to the invention, we carry out a well-scale simulation of a constant-flow acid injection on a rock sample that is 2 m long, 40 cm wide and 40 cm high.

Gridding and Initialization:

After gridding the sample by means of a Cartesian grid (in this case, the grid is Cartesian and not radial as in the case of a well for example), the input data of the model are determined or defined:

Initial injection velocity $V_0=1.0^{-4}$ m/s

Initial concentration $C_0$=210 Kg/m3

Initial porosity $\epsilon_0$=0.36

Initial permeability $K_0=2.318.10^{-12}$ m$^2$

Kinematic viscosity $\mu=1.10^{-3}$ Pa/s

Rock density $\rho^{o}$=2160 Kg/m3

Permeability in the dissolved medium $K_f=8{,}331.10^{-8}$ m$^2$

Mass stoichiometric coefficient v=1

Characteristic length of the problem L=0.1 m.

Experimental Determination of the Parameters

Reference results are determined by means of core-scale simulations using the model developed by Golfier, F. et al., "*On the ability of a Darcy-scale model to capture wormhole formation during the dissolution of porous media*", Journal of Fluid Mechanics 547, 213-254, 2002. These simulations are carried out around the flow rate used thereafter for well-scale simulation. A series of simulations is thus carried out using a core-scale single-medium model in a domain that represents a small portion of the domain to be simulated, over a flow rate range that is sufficiently wide to reproduce the different possible dissolution figure types (compact front, conical wormhole, dominant wormhole, branched wormholes and uniform dissolution). The dimensions of the domain are 25 cm in length, 40 cm in width and 1 mm in height.

In order to determine coefficient $\chi$ linked with the permeability/porosity relation, we use the pressure and porosity results obtained from the core-scale simulations, to which the procedure described above is applied. We thus obtain the optimum value X=3.08.

We then use the well-scale model in a domain equivalent to the domain used on a small scale, by applying the same injection conditions. For each core-scale simulation at a given flow rate, we use an optimization algorithm to determine the equivalent parameters used by our well-scale model for each flow rate. The results are given in Tables 1 and 2.

TABLE 1 shows the values of the parameters of the model using dissolution terms $g_{1M}$ and $g_{1H}$ for different injection velocities.

| $V_0$ (m/s) | A | $\phi_H$ | $\Delta y$ (m) | $H^M$ | $H^H$ |
|---|---|---|---|---|---|
| 9.27E-08 | 0.0023 | 0.5 | 0.2 | 1 | 1 |
| 4.64E-06 | 0.001 | 0.05 | 0.0041 | 1.1 | 1.48 |
| 9.27E-06 | 0.0023 | 0.08459 | 0.005 | 1.1939 | 1.461 |
| 2.32E-05 | 0.04 | 0.08459 | 0.005884 | 1.16373 | 1.2 |
| 4.64E-05 | 0.04 | 0.0769 | 0.006 | 1.13 | 1.207 |
| 9.27E-05 | 0.04 | 0.07 | 0.006 | 1.13 | 1.3 |
| 1.85E-04 | 0.04773 | 0.0697 | 0.01 | 1 | 1.226 |
| 9.27E-04 | 0.3936 | 0.136 | 0.1 | 1.0012 | 2.99 |
| 9.27E-03 | 7 | 0.2 | 0.1366 | 1.5105 | 3 |

TABLE 2 shows the values of the parameters of the model using dissolution terms $g_{2M}$ and $g_{2H}$ for different injection velocities.

| $V_0$ (m/s) | $n_1$ | $\phi_H$ | $\Delta y$ (m) | $H^M$ | $H^H$ | $\gamma$ | $n_2$ |
|---|---|---|---|---|---|---|---|
| 9.27E-08 | 0 | 0.5 | 10 | 1 | 1 | 0.667 | 0 |
| 4.64E-06 | 0.265 | 0.499 | 0.1783 | 3.8 | 4.3 | 0.755 | 0.83 |
| 9.27E-06 | 0.345 | 0.499 | 0.143 | 2.9722 | 3.962 | 0.71 | 0.8 |
| 2.32E-05 | 0.345 | 0.5 | 0.0938 | 2.5 | 3.5 | 0.68 | 0.55 |
| 4.64E-05 | 0.339 | 0.5 | 0.04859 | 2.47 | 3.35 | 0.667 | 0.5 |
| 9.27E-05 | 0.3 | 0.5 | 0.0344 | 2.479 | 3.3 | 0.705 | 0.45 |
| 1.85E-04 | 0.2918 | 0.48 | 0.0678 | 2.522 | 3.15 | 0.8 | 0.35 |
| 9.27E-04 | 0.149 | 0.4537 | 0.1157 | 2.5742 | 2.8547 | 0.8858 | 0.2902 |
| 9.27E-03 | 0.0454 | 0.4148 | 0.1852 | 2.797 | 2.623 | 0.902 | 0.2728 |

In order to determine the well-scale parameters to be used for acid injection, an interpolation of the values obtained in the previous stage is carried out. For an injection velocity of 1.10-4 m/s, we obtain the following parameters:

With dissolution terms $g_{1M}$ and $g_{1H}$:

$$A = 0.0406 \quad \phi_H = 0.07$$

$$H^M = 1.192 \quad H^H = 1.447$$

$$\Delta y = 0.006314$$

With dissolution terms $g_{2M}$ and $g_{2H}$ $$n_1 = 0.299 \quad n_2 = 0.4421$$

$$\gamma = 0.7124 \quad \phi_H = 0.498$$

$$H^M = 2.482 \quad H^H = 3.288$$

$$\Delta y = 0.037$$

Well-Scale Acidification Modelling

To model acidification, we use the dual-medium model according to the invention (equations 6 to 15). The sample is homogeneous in porosity and permeability on the scale of the section. The section-scale model is therefore applied in a single dimension, in the direction of injection.

Figure 6:
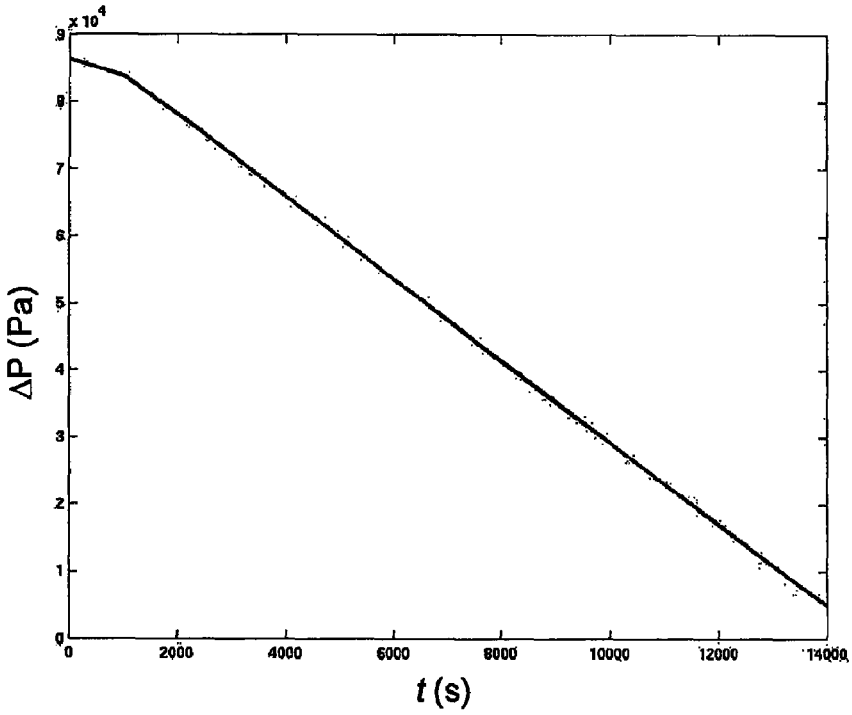
FIG. 6 illustrates results using dissolution terms $g_{1H}$ and $g_{1M}$. It shows the pressure drop in the sample in the course of time.
Figure 8:
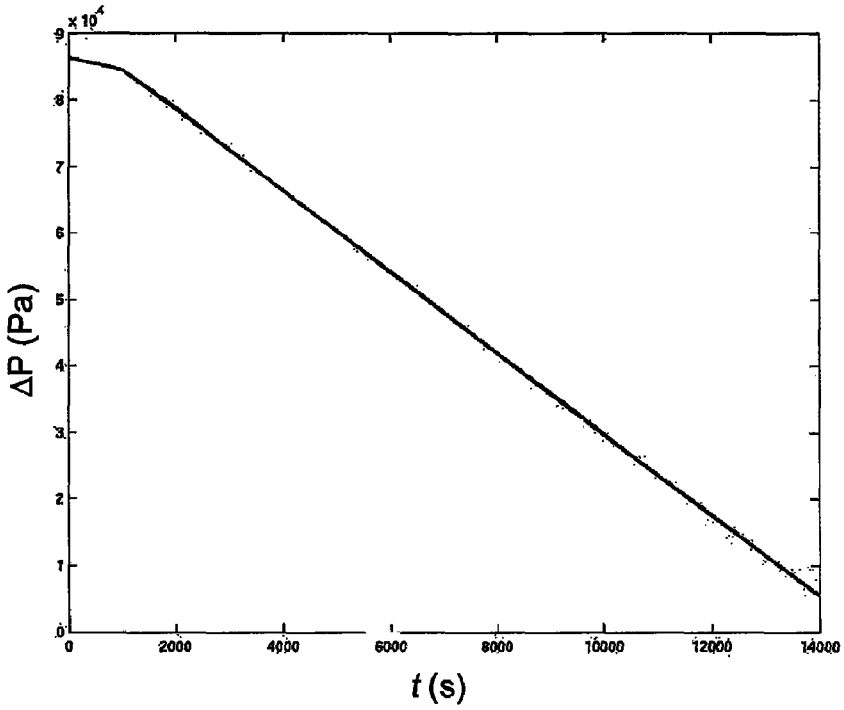
FIG. 8 illustrates results using dissolution terms $g_{2M}$ and $g_{2M}$. It shows the pressure drop in the sample in the course of time.

FIGS. 6 and 8 show the pressure difference between the sample inlet and outlet, ΔP expressed in Pascal, as a function of the time t expressed in second.

Figure 7:
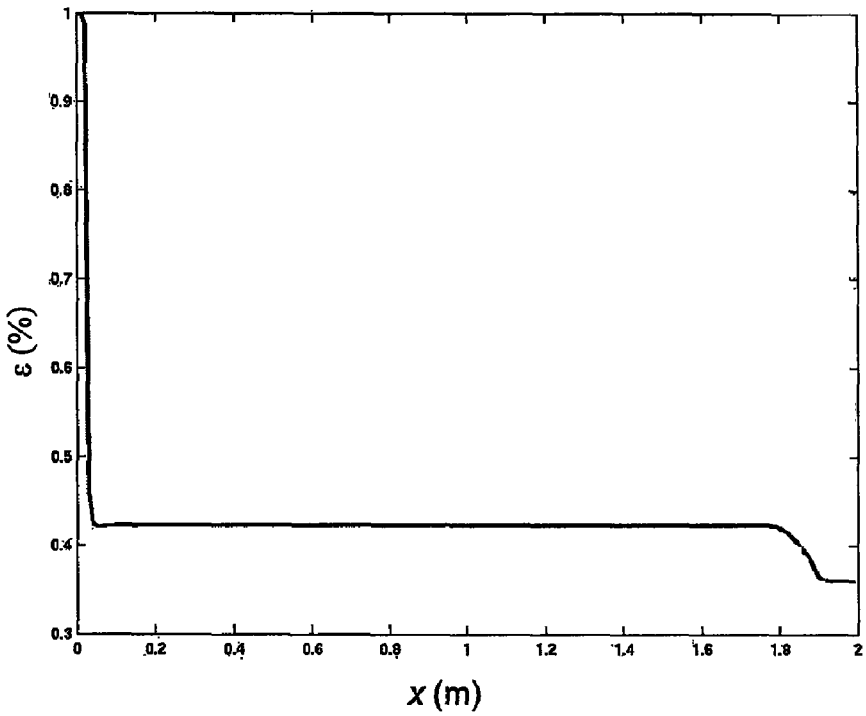
FIG. 7 illustrates results using dissolution terms $g_{1H}$ and $g_{1M}$. It shows the porosity of the sample as a function of the abscissa.
Figure 9:
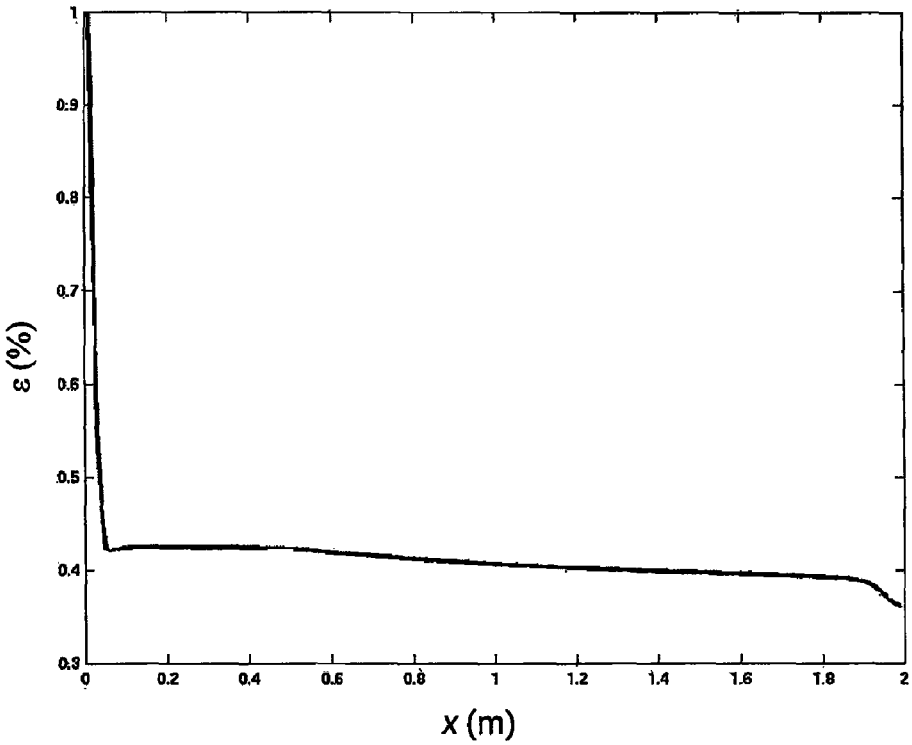
FIG. 9 illustrates results using dissolution terms $g_{2M}$ and $g_{2M}$. It shows the porosity of the sample as a function of the abscissa.

FIGS. 7 and 9 show the porosity $\epsilon$ of the sample as a function of the abscissa $\chi$ of the sample in meter.

FIGS. 6 and 7 illustrate the results for the model using dissolution terms $g_{1M}$ and $g_{1H}$. The breakthrough time is 4 hours and 2 minutes. The volume of acid injected is $2.677.10^{-1}$ $m^3$.

FIGS. 8 and 9 illustrate the results for the model using dissolution terms $g_{2M}$ and $g_{2M}$. The breakthrough time is 3 hours and 53 minutes. The volume of acid injected is $2.244.10^{-1}$ $m^3$.

Both models show a high pressure drop and a low porosity increase, which is characteristic of wormholing. They also show that approximately 4 hours injection at an injection velocity of $1.10^{-4}$ m/s are necessary to obtain a wormhole that is two meters long, a length characteristic of acid well stimulation.

The invention claimed is:

1. A method for optimizing acid injection parameters by modelling acidification within a porous medium as a result of acid injection, wherein said medium is represented by a computer-implemented dual-medium model, the method comprising:

a) constructing said dual-medium model in a computer
   by considering a first sub-medium favourable to dissolution breakthroughs, and a second sub-medium that is not favourable to dissolution breakthroughs,
   by carrying out, for each one of said sub-media, a description of acid transport, mass conservation of said sub-medium and mass conservation of said acid, the description being specified in meters, and
   by describing an acid transfer from one sub-medium to the other sub-medium, by means of equations obtained by carrying out a volume averaging, specified in meters, of equations describing a propagation of an acid in a single-medium model specified in centimeters, said equations comprising a dissolution term depending on a norm of a local acid velocity and on a mean porosity specified in meters;

b) initializing said dual-medium model from one or more experimental calibrations;

c) modelling said acidification, by means of execution of said dual-medium model, by determining physical parameters representative of said porous medium and physical parameters relative to the acid injected;

d) optimizing acid injection parameters by using said physical parameters.

2. A method as claimed in claim 1, wherein said physical parameters representative of said porous medium are selected, for each one of the sub-media, from among the following parameters: the mean porosity, the permeability specified in meters, and the mean total pressure.

3. A method as claimed in claim 1, wherein said physical parameters relative to the acid are selected, for each one of the sub-media, from among the following parameters: the mean acid concentration, the mean Darcy's velocity.

4. A method as claimed in claim 1, wherein said dissolution term is defined as the product of a mean acid concentration, specified in meters, by a coefficient depending on a local acid velocity.

5. A method as claimed in claim 1, wherein said dissolution term is defined as the product of a parameter by the divergence of a product between an acid concentration, a fractional flow function and a velocity vector.

6. A method as claimed in claim 1, wherein said one or more experimental calibrations are based on simulations in scales smaller than in meters.

7. A method as claimed in claim 1, wherein said one or more experimental calibrations are based on constant-flow acid injection surveys conducted on a sample of said medium.

8. A method as claimed in claim 1, wherein said porous medium is a carbonate reservoir through which a well is drilled, acid injection being carried out to stimulate hydrocarbon production through said well, and wherein optimum acid injection parameters are determined by carrying out the following stages:

a) constructing a grid of said well and of its neighbourhood;

b) defining initial acid injection parameters;

c) determining, by modelling the acidification due to acid injection, at least the following physical parameters representative of said reservoir: a porosity and a permeability of said reservoir after acid injection ;

d) simulating the well production according to said porosity and to said permeability by means of a reservoir simulator ;

e) modifying said initial parameters and repeating stage c) until a production maximum is obtained.

9. A method as claimed in claim 8, wherein said initial parameters are selected from among at least one of the following parameters: acid injection rate, initial injection velocity, the volume of acid injected, the concentration of the acid used for stimulation, zones to be treated.

* * * * *